US011052534B2

(12) United States Patent
Medure

(10) Patent No.: US 11,052,534 B2
(45) Date of Patent: Jul. 6, 2021

(54) TILE-CUTTING MEASUREMENT DEVICE

(71) Applicant: Preston Medure, Gilbert, AZ (US)

(72) Inventor: Preston Medure, Gilbert, AZ (US)

( * ) Notice: Subject to any disclaimer, the term of this patent is extended or adjusted under 35 U.S.C. 154(b) by 286 days.

(21) Appl. No.: 16/266,396

(22) Filed: Feb. 4, 2019

(65) Prior Publication Data

US 2020/0246964 A1 Aug. 6, 2020

(51) Int. Cl.

| | |
|---|---|
| ***E04F 15/08*** | (2006.01) |
| ***B25H 7/04*** | (2006.01) |
| ***E04F 21/00*** | (2006.01) |
| ***B25H 7/02*** | (2006.01) |

(52) U.S. Cl.

CPC ..... *B25H 7/045* (2013.01); *B25H 7/02* (2013.01); *E04F 21/0076* (2013.01)

(58) Field of Classification Search

CPC ..... E04F 21/0076
USPC ..... 33/526, 527
See application file for complete search history.

(56) References Cited

U.S. PATENT DOCUMENTS 2,814,163 A * 11/1957 Krulwich ..... C03B 33/12 225/96
3,183,598 A * 5/1965 Parr ..... E04F 21/0076 33/527
4,030,195 A * 6/1977 Insolio ..... B26B 5/00 30/164.9
4,858,327 A 8/1989 Johns
5,038,490 A * 8/1991 Armstrong ..... E04F 21/20 33/527
5,205,045 A * 4/1993 Liu ..... B23Q 9/005 33/426
5,181,326 A 6/1993 Eberline
5,471,758 A 12/1995 White
5,701,680 A 12/1997 Garcia et al.
5,922,157 A 7/1999 Snider
6,101,730 A 8/2000 Marino
6,195,904 B1 3/2001 Greer
6,305,090 B1 * 10/2001 Julien ..... B43L 13/02 33/41.5
6,481,112 B1 11/2002 White
7,685,730 B2 3/2010 Dozier
(Continued)

FOREIGN PATENT DOCUMENTS

EP 1209438 A1 5/2002
GB 2471867 A 1/2011

*Primary Examiner* — George B Bennett
*Assistant Examiner* — G. Bradley Bennet
(74) *Attorney, Agent, or Firm* — Morgan Law Offices, PLC

(57) ABSTRACT

A tile-cutting measurement device includes a telescoping elongated body. The telescoping elongated body has a first distal end and a second distal end. A tile marker holder is disposed on the second distal end substantially parallel to the elongated body. The tile marker holder holds a tile marker. The first distal end of the tile-cutting measurement device is placed against a vertical surface such as a wall. When the tile-cutting measurement device travels along the wall, the marker traces a line along a loose tile to be cut that corresponds to the contours of the vertical surface. After the tile is measured in this manner, it will be cut along the line. The cut side of the tile is then fitted along the vertical surface. Advantageously, the tile-cutting measurement device is a portable and easy-to-use tool that allows for precise tile cutting measurements.

10 Claims, 3 Drawing Sheets

(56) References Cited

U.S. PATENT DOCUMENTS

| | | | | |
|---|---|---|---|---|
| 2007/0163130 | A1* | 7/2007 | Kyoung-Soo | B43L 7/02 33/42 |
| 2010/0192393 | A1* | 8/2010 | Smith | E04F 21/0076 33/32.1 |
| 2010/0252016 | A1* | 10/2010 | Flude | E04F 21/20 125/1 |
| 2013/0036620 | A1* | 2/2013 | Chancellor-Maddison | G01B 3/14 33/527 |

* cited by examiner

TILE-CUTTING MEASUREMENT DEVICE

TECHNICAL FIELD

The present invention relates to a device to measure tiles for cutting.

BACKGROUND

Installation of floor tiling entails a large commitment of labor and time. One difficulty that workers encounter that can slow down the job is measuring and cutting tiles so that they fit properly against the perimeter of the room or around an obstacle. A traditional way to measure the necessary tile cuts is by using a measuring tool such as a ruler or tape measure. Other measuring tools more specific to tile cutting include the Eberline tile measuring tool as taught in U.S. Pat. No. 5,870,831, and various paper templates. Although satisfactory, use of these tools requires a great deal of time and precision. Additionally, the prior art includes more complex devices, but such tools tend to be expensive, heavy and bulky.

SUMMARY

A tile-cutting measurement device includes a telescoping elongated body. The telescoping elongated body has a first distal end and a second distal end. A tile marker holder is disposed on the second distal end substantially parallel to the elongated body. The tile marker holder holds a tile marker. The first distal end of the tile-cutting measurement device is placed against a vertical surface such as a wall. When the tile-cutting measurement device travels along the wall, the marker traces a line along a loose tile to be cut that corresponds to the contours of the vertical surface. After the tile is measured in this manner, it will be cut along the line. The cut side of the tile is then fitted along the vertical surface. Advantageously, the tile-cutting measurement device is a portable and easy-to-use tool that allows for precise tile cutting measurements.

DETAILED DESCRIPTION OF EXAMPLE EMBODIMENTS

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like elements but not necessarily the same or identical elements throughout.

Figure 1:
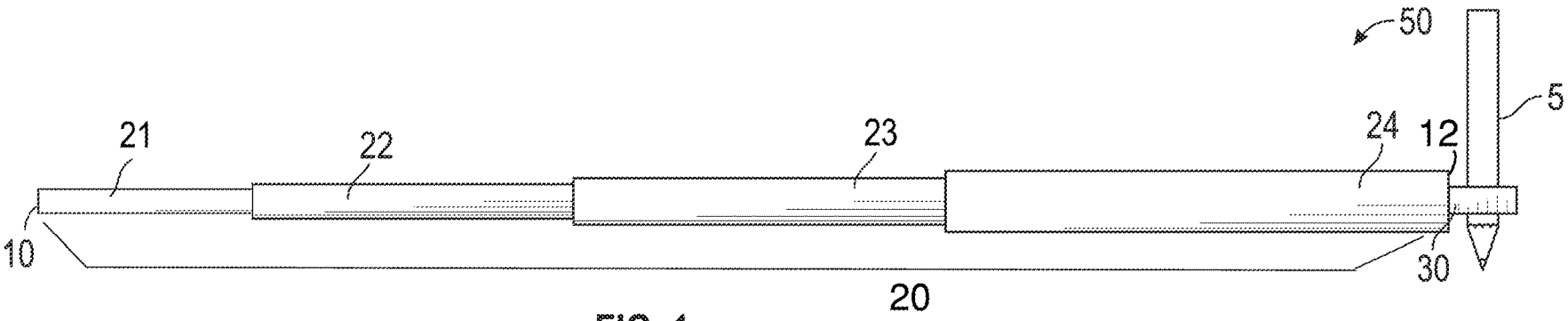
FIG. 1 illustrates a side view of a tile-cutting measurement device, according to an example embodiment of the disclosure.

Referring to FIG. 1, a side view of a tile-cutting measurement device 50, according to an example embodiment of the disclosure, is illustrated. As shown, the tile-cutting measurement device 50 comprises a telescoping elongated body 20 that includes a plurality of segments 21-24. The elongated body 20 has a first distal end 10 and a second distal end 12, the first distal end 10 and the second distal end 12 situated on opposite sides of the elongated body 20. The first distal end 10 can include a felt surface or the like. Additionally, a tile marker holder 30 extends horizontally from the second distal end 12 and is substantially parallel to the elongated body 20. The tile marker holder 30 includes a hole 32 permitting a tile marker 5 to be inserted creating a friction fit. As will be described in greater detail, the first distal end 10 of the tile-cutting measurement device 50 is placed along a vertical surface such as a wall. When the tile-cutting measurement device 50 travels along the vertical surface, the marker 5 traces a line along a tile to be cut that corresponds to the contours of the vertical surface. After the tile is measured in this manner, it will be cut along the line. The cut side of the tile will then be fit along the vertical surface.

Figure 2:
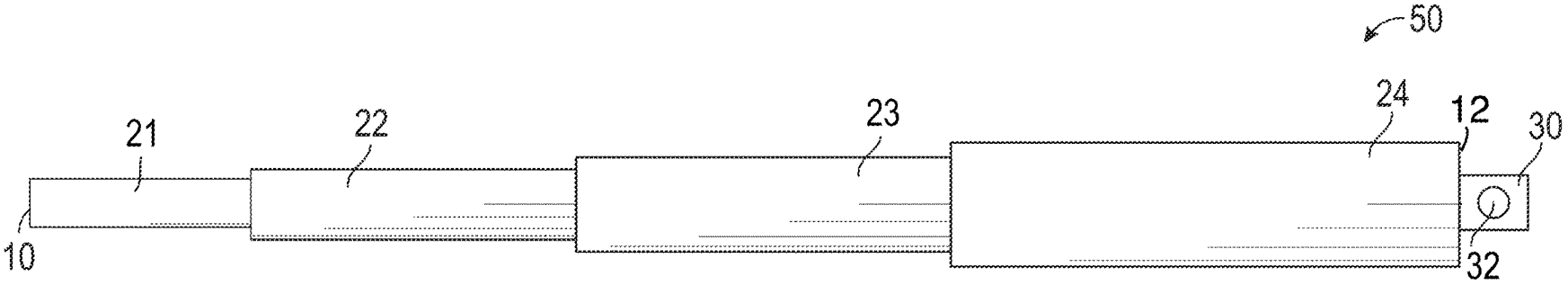
FIG. 2 illustrates a top view of the tile-cutting measurement device, according to an example embodiment of the disclosure.

FIG. 2 illustrates a top view of the tile-cutting measurement device 50.

Figure 3:
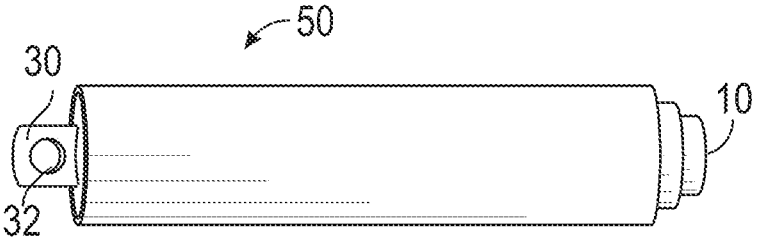
FIG. 3 illustrates a perspective view of the tile-cutting measurement device in a storage configuration, according to an example embodiment of the disclosure.

FIG. 3 illustrates the tile-cutting measurement device 50 in the storage position. Notably, when the tile-cutting measurement device 50 is in the storage position, the device can be easily carried and stored. In the illustrated embodiment, the telescoping nature of the elongated body 20 permits the user to extend the tile-cutting measurement device to an appropriate length for the tiles being installed. Because tiles come in various sizes, the tile-cutting measurement device 50 can likewise be sized to accommodate various sized tiles. In an embodiment, the tile-cutting measurement device 50 includes four segments. However, in other embodiments another number of segments (and lengths) may suffice.

Figure 4:
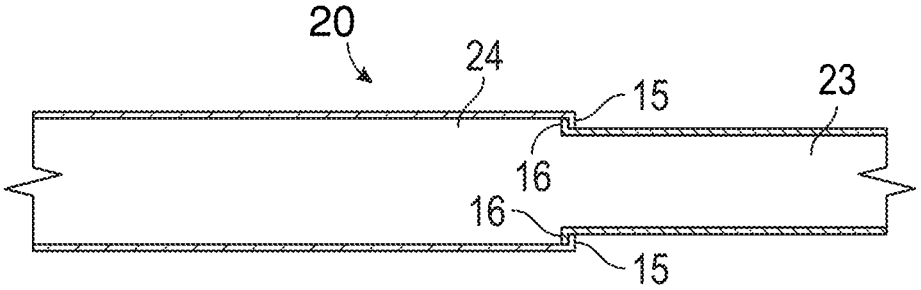
FIG. 4 illustrates a cutaway view of the tile-cutting measurement device, according to an example embodiment of disclosure.

FIG. 4 illustrates a cutaway view of the elongated body 20, according to an example embodiment. Although adjacent segments 24, 23 are depicted in the diagram, it is to be understood that all of the segments comprising the elongated body 20 would be coupled in substantially the same manner. It is also to be understood that the segments comprising the elongated body 20 would be nested, permitting the elongated body 20 to assume the storage position as shown (FIG. 3). Furthermore, it is to be appreciated that telescoping tubing such as described herein in known in the art, and the example structure disclosed herein is not meant to be limiting. In the illustrated embodiment, the segment 24 has an inner diameter slightly greater than the outer diameter of the segment 23 allowing segment 23 to be inserted into the segment 24 and to freely move when pulled apart or pushed together. The segment 23 includes a flange 18 that is constrained by a stopper 16, disallowing the segment 23 from being pulled entirely out of segment 24. Referring again to FIG. 4, segments 21-24 are shown as being oval shaped (i.e., ovoid). However, other such shapes such as cylindrical may suffice. In some embodiments, the segments are made from tubing having square or rectangular cross sections, preferably with tapered corners. The tubing used to form the segments can be made of any suitable material, such as stainless steel, aluminum, plastic, carbon fiber, etc. Additionally, it is to be understood that although the forgoing disclosure mentions a telescoping body, in some embodiments, the tile-cutting measurement device will not have a telescoping elongated body (e.g., instead, a single continuous body).

Figure 5:
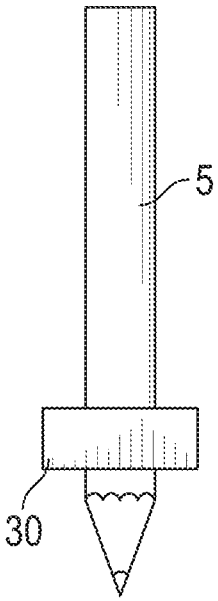
FIG. 5 illustrates a close-up view of a tile marker of the tile-cutting measurement device, according to an example embodiment of the disclosure.

FIG. 5 illustrates a close-up view of the tile marker 5 of the tile-cutting measurement device 50, according to an example embodiment of the disclosure. As shown, the marker 5 is pointed downward. It is to be understood that the marker 5 can be any suitable marking device.

Figure 6:
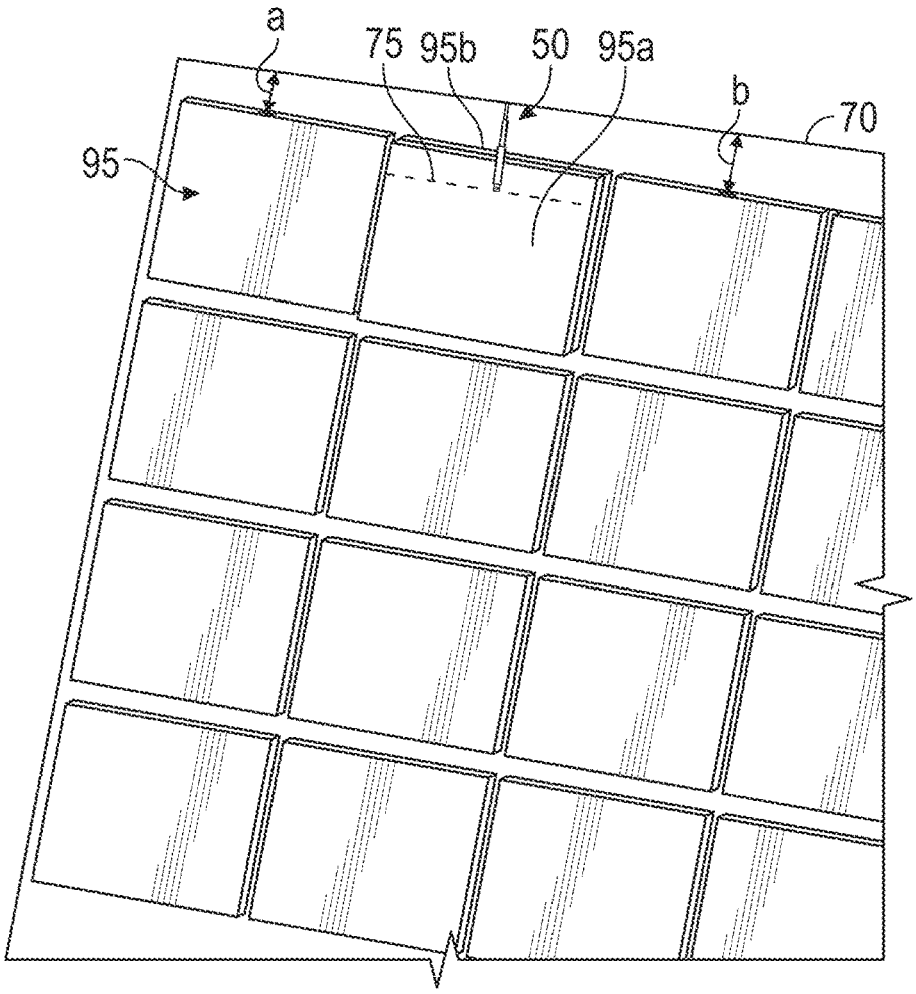
FIG. 6 illustrates the tile-cutting measurement device in use to measure floor tiling, according to an example embodiment of the disclosure.
Figure 7:
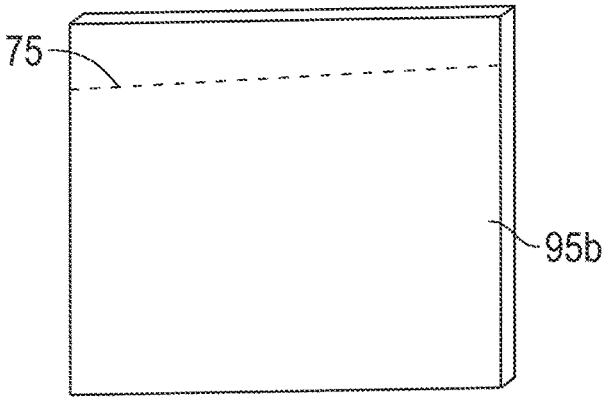
FIG. 7 illustrates an example tile having a tile cut line formed using the tile-cut measuring device, according to an example embodiment.

FIG. 6 illustrates the tile-cutting measurement device 50 in use to measure floor tiling 95, according to an example embodiment of the disclosure. As shown, many tiles have already been laid on the floor, each such tile not needing to be cut since there was available room for the tile. However, there is space adjacent the wall 70 and the edge of the already-laid tile that needs to be filled with tiling since it will not accommodate whole tiles therein. Accordingly, tiling will have to be cut for this area. Notably, the wall 70 is not parallel to the tiling edge. In particular, the distance b from the wall 70 to the tile edge is greater than the distance a, signifying an angular tile cut is required. In operation, the user places a loose tile 95*a* atop an installed tile 95*b*, as shown. The user then places the second distal end 10 of the tile-cutting measurement tool 50 against the wall 70, and drags the device 50 along the wall 70 with the marker 5 faced down and touching the top surface of the loose tile 95*a*. When the tile-cutting measurement device is slid along the wall 70 in this manner, the marker creates a tile cut line 75 on the loose tile 95*a* (most clearly shown in FIG. 7). The tile 95*a* is then cut along the line 75, and the portion cut from the tile 95*a* is placed between the wall 70 and the tile 95*b*. In particular, the straight (non-cut) edge of the tile 95*a* is placed adjacent the tile 95*a* with the cut edge of the tile 95*b* adjacent the wall. Of course, in between adjacent tiles there will be sufficient space for grout or the like. The user will do the same operations for the remaining space between the wall 70 and the tile edge.

It is to be understood that although the tile-cutting measurement device 50 was described with respect to measuring tile to be cut for placement along a wall 70, the tile-cutting measurement device 50 could be used to measure tile to be cut for installation along other vertical surfaces or around obstacles, such as structures or obstructions elsewhere along the flooring such as around a support beam. Additionally, it is to be understood that tiling comes in various shapes, material and sizes. The tile-cutting measurement device 50 would be suitable for all these types of tiles as well. For instance, although the illustrated embodiment shows an array of traditional square tiles, other shapes of tiles including round and irregular shaped tiles could be measured for cutting using the tile-cutting measurement device 50.

Although the features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A tile-cutting measurement device, comprising:

a straight elongated telescoping body having a first distal end and a second distal end, the first distal end and the second distal end substantially collinear and situated on opposite sides of the elongated telescoping body; and a tile marker holder attached to the second distal end of the elongated telescoping body;

wherein the first distal end is substantially flat along a perpendicular vertical surface;

wherein the elongated telescoping body is extendable in length by pulling, and when pulled the first distal end and the second distal end remain substantially collinear; and wherein the elongated telescoping body is an entirely metal telescoping tubing between the first distal end and the second distal end.

2. The tile-cutting measurement device of claim 1, wherein the elongated telescoping body includes a plurality of segments.

3. The tile-cutting measurement device of claim 2, wherein the segments are interlocking.

4. The tile-cutting measurement device of claim 1, wherein tile marker holder includes a tile marker attached thereto.

5. The tile-cutting measurement device of claim 1, wherein the elongated telescoping body has a storage position and an extended position, wherein in the storage position the elongated telescoping body is less than half the length of the extended position.

6. The tile-cutting measurement device of claim 1, wherein the length of the elongated telescoping body can be set by the user.

7. The tile-cutting measurement device of claim 1, wherein the tile-cutting measurement device is less than 10 inches in length when in the storage position.

8. The tile-cutting measurement device of claim 1, wherein the first distal end includes a felt surface.

9. The tile-cutting measurement device of claim 1, wherein the elongated telescoping body is stainless steel.

10. A method of using a tile-cutting measurement device, comprising:

providing the tile-cutting measurement device of claim 1;

positioning the first distal end of the tile-cutting measurement device against a vertical surface;

moving the tile-cutting measurement device along the vertical surface, wherein, when the tile-cutting measurement device moves along the wall, a marker attached to the second distal end of the tile-cutting measurement device traces a line along a loose tile to be cut that corresponds to contours of the vertical surface.

* * * * *